US005295791A

United States Patent [19]

Meise

[11] Patent Number: 5,295,791

[45] Date of Patent: Mar. 22, 1994

[54] TAPERED FLUID COMPRESSOR & REFRIGERATION APPARATUS

[76] Inventor: William H. Meise, P.O. Box 344, Penns Park, Pa. 18943

[21] Appl. No.: 6,267

[22] Filed: Jan. 19, 1993

[51] Int. Cl.[5] ..... F04B 19/24; F25B 1/00

[52] U.S. Cl. ..... 417/52; 62/467; 417/413 R

[58] Field of Search ..... 62/115, 498, 6, 467; 417/413 R, 52, 322

[56] References Cited

U.S. PATENT DOCUMENTS 2,512,743 6/1950 Hansell ..... 417/322 X
5,167,124 12/1992 Lucas ..... 62/467 X
5,174,130 12/1992 Lucas ..... 62/498

OTHER PUBLICATIONS

Cool Sounds, Scientific American pp. 120–121 Nov. 1992.

*Primary Examiner*—William E. Wayner

[57] ABSTRACT

A fluid compressor or pump includes a driver such as a reciprocating piston or a voice-coil actuated diaphragm, which creates pressure waves in the fluid. The waves propagate through a tapered tube, in which the pressure increases as the waves move toward the small end. A valve at the small end of the tapered tube allows higher-pressure portions of the pulses of fluid to emerge. The pulses of pressurized fluid may be applied directly to a utilization apparatus, or they may be accumulated in a tank. The tapered tube may be more than one-tenth wavelength long, and preferably one-quarter wavelength long, to take advantage of the effects of reflections. A refrigeration unit including such a compressor dispenses with an accumulator, and provides heat-dissipating fins on the outer surface of the tapered tube.

4 Claims, 2 Drawing Sheets

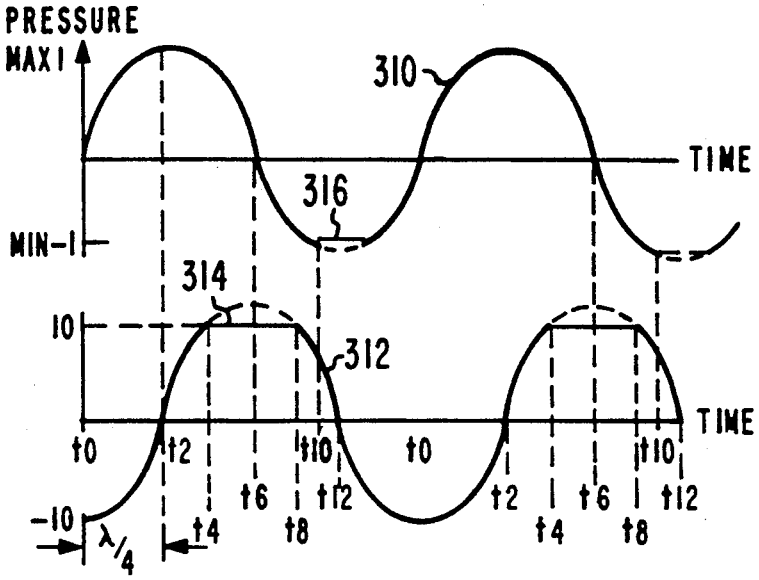
Fig. 3a
Fig. 3b
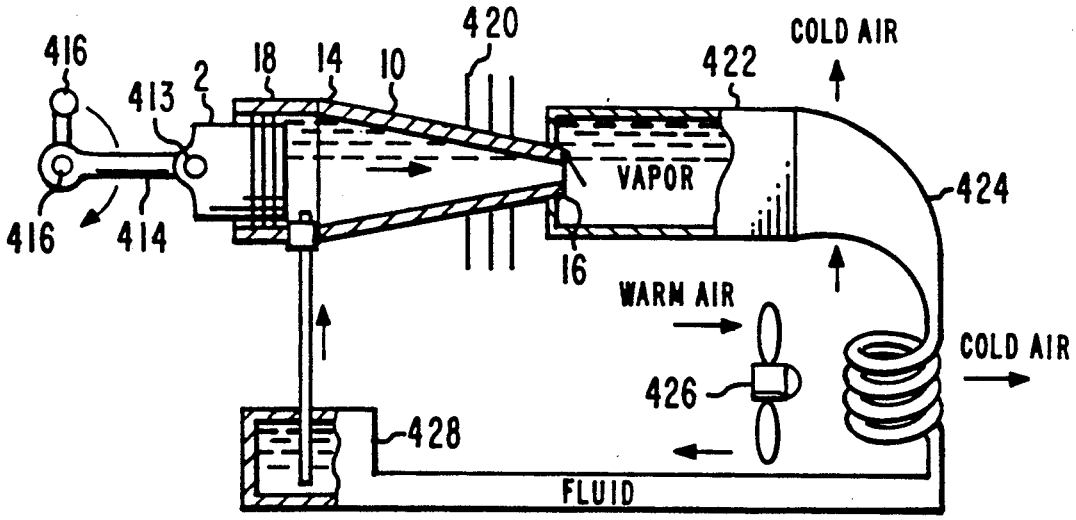
Fig. 4

TAPERED FLUID COMPRESSOR & REFRIGERATION APPARATUS

BACKGROUND OF THE INVENTION

This invention relates to compressors or pumps for fluids such as gases or liquids, and more particularly to fluid compressors in which an elongated, tapered tube is periodically pulsed with pressure waves from a low-pressure actuator, and in which the pressure associated with the wave is increased along the length of the tube. A refrigeration or air-conditioning unit uses such a compressor.

Air conditioning and refrigeration devices are widely used, and each uses a large amount of power. It is in the best interest of society and the consumer to provide high efficiency. Among the disadvantages of conventional motor-driven reciprocating-piston compressor units used for refrigeration and for air conditioning is the compressor noise. This noise arises in part because moving parts of the compressor, such as the piston, wrist pin, connecting arm, and crankshaft, are subjected to rapid pressure variations, and these variations can rise as high as the peak system pressure.

SUMMARY OF THE INVENTION

A compressor includes a large area source of pulses of fluid pressure, which are coupled to the large end of a tapered tube. The pressure pulse or pulses, propagating in the tube toward the small-diameter end, increases in pressure. At the small end of the tube, the resulting compressed fluid pulse is coupled to a fluid container or to a utilization apparatus. In an embodiment of the invention, a differential-pressure-activated valve gates the compressed fluid pulses, and creates a unidirectional fluid flow through the compressor. Two valves may be used with each compressor, one at the high-pressure side, and one at the low-pressure side. A refrigeration compressor using a tapered tube has heat-dissipating fins affixed to the outside of the tube.

DESCRIPTION OF THE DRAWINGS

FIGS. 3*a* and 3*b* are amplitude-versus-time plots of pressure variations at the large and small ends, respectively, of the tube of FIG. 1, illustrating the effect of propagation delay and pressure reflections; and FIG. 4 is a simplified schematic diagram of a refrigeration unit using a fluid compressor in accordance with FIG. 1.

DESCRIPTION OF THE INVENTION

According to the invention, the pressure pulse generator, which may be a reciprocating piston or plunger, voice-coil-actuated diaphragm, or the like, operates at relatively low pressure. The low pressure in itself tends to reduce system noise, and lends itself to improved efficiency. In the described embodiment, the pressure variations are approximately sinusoidal, thereby tending to reduce the amplitudes of high-frequency vibrations, which further increases efficiency and makes the equipment less offensive during operation. The low-pressure fluid compression pulses are transformed into high-pressure fluid pulses by an elongated tapered tube through which the pressure pulses propagate. In general, the velocity of propagation of pressure pulses in a fluid (i.e. the speed of sound in the fluid) is a known value, which tends to remain constant at a particular pressure and temperature. The velocity of propagation of pressure waves in air, for example, is about 1100 ft/sec at sea level and room temperature. The low-pressure waves at the large end of the tube propagate toward the small end of the tube, and the fluid pressure tends to increase as the pressure wave propagates through the decreasing cross-section of the tube. This is in contrast to the well-known principle that the static fluid pressure at the bottom of a container depends upon the head of fluid, and not upon the shape of the container, whereas the invention contemplates dynamic conditions. The high-pressure portion of the pulse which appears at the small end of the tube can be used for various purposes, or pressurized fluid can be accumulated in a tank for later use.

It should be noted that the pressure variations or pulses which propagate through the tube include both high- (positive) and low-pressure (negative) portions. The description is couched in terms of propagation of the high-pressure or compression portion of the pulses, which seems appropriate for a positive-pressure pump or compressor. The description could as easily be in terms of the rarefaction component of the pressure variations or pulses.

Figure 1:
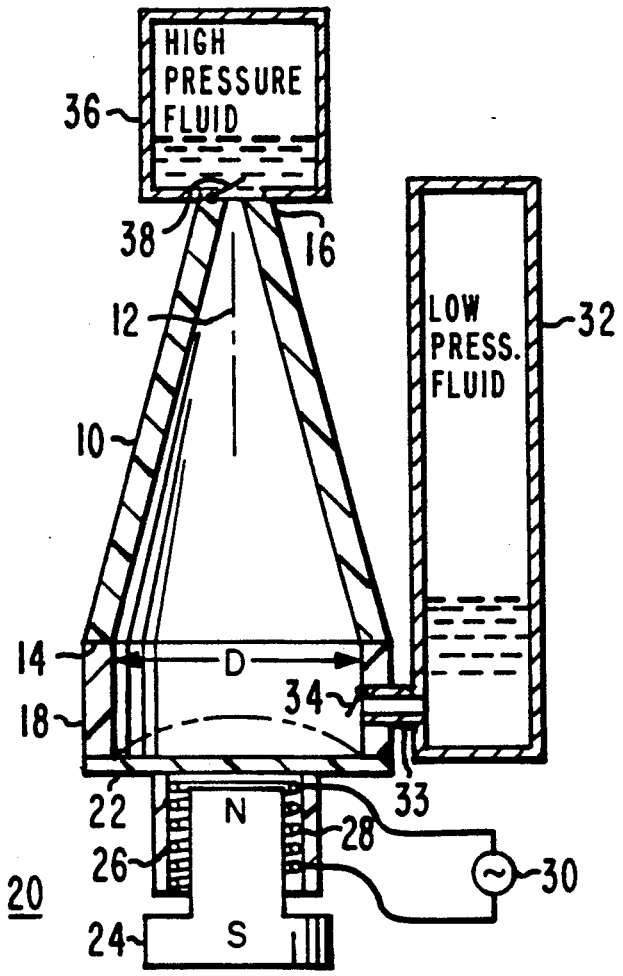
FIG. 1 is a simplified cross-sectional view of a compressor according to the invention, including a tapered tube.

FIG. 1 is a simplified cross-sectional elevation view of a fluid compressor according to the invention. In FIG. 1, tapered circular-cross-section tube 10 is elongated in the direction of axis 12, and has a large-diameter end 14 and a small-diameter end 16. As illustrated, large-diameter end 14 is connected to a cylindrical section 18. Section 18 is not strictly necessary, but it may be convenient for attachment of an actuator or valve. The diameter D of cylindrical section 18 is equal to that of large end 14 of the tapered tube. At the bottom of cylindrical section 18, a voice-coil actuator designated generally as 20 drives an elastic diaphragm 22. Actuator 20 includes a cylindrical axial magnet 24 with north (N) and south (S) magnetic poles. Magnet 24 coacts with a magnetic winding 28 wound on a nonmagnetic cylinder or form 26. Those skilled in the art know that voice-coil actuator 20 moves axially under the impetus of electric current flow in coil 28 attributable to a source or oscillator illustrated by a symbol 30.

In FIG. 1, a container 32 of low-pressure fluid communicates by way of a tube 33 with the interior of cylindrical portion 18 of the compressor structure, and may be dimensioned to provide a sufficient head of fluid to completely fill tapered tube 10 with fluid.

Figure 2:
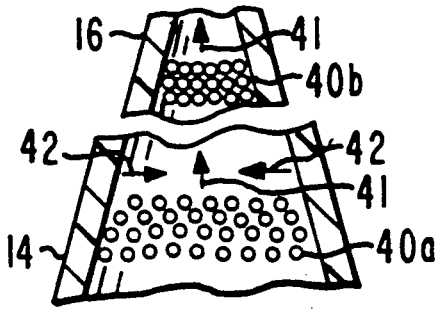
FIG. 2 is a cross-section of two separate portions of the tube of FIG. 1, illustrating the forces acting on the fluid molecules as pressure pulses propagate.

FIG. 2 is a cross-section of the tapered tube of FIG. 1, conceptually illustrating the effect of the taper on a pressure wave, designated 40, propagating in the direction of arrow 41 within the fluid in the tube. Elements of FIG. 2 corresponding to those of FIG. 1 are designated by like reference numerals. As illustrated, the compression portion of the pressure wave consists of closely spaced dots representing fluid molecules in the moving compression region. Those skilled in the art know that the compression wave itself moves, but that the individual fluid molecules tend to merely oscillate about an average position. At the position of the wave illustrated as 40*a*, the molecules under the influence of the pressure wave are laterally constrained at a relatively large-diameter portion of the tube. A moment later, propagation of the wave causes it to arrive at location 40b, where the lateral extent of the tube is much diminished, and the molecules are more closely packed. Another way of looking at conditions affecting the pressure is that the walls of the tube effectively "move in" as the wave propagates toward smaller end 16 of the tube, resulting in an additional compression "force", represented in FIG. 2 by arrows 42, which force acts to further compress the fluid.

FIG. 3a illustrates a pressure-versus-time plot 310 representing the pressure at larger end 14 of tapered tube 10 of FIG. 1. As illustrated in FIG. 3a, plot 310 is sinusoidal with time, corresponding to the displacement of diaphragm 21 under the impetus of force provided by magnetic interaction of magnet 24 and coil 28. The peak amplitude of pressure wave 310 is illustrated as unity, with the positive or compression peak occurring at recurrent times t2, and the negative peak at times t12. In FIG. 3b, plot 312 is similar to plot 310 of FIG. 3a, and represents the pressure variations at small end 16 of tube 10 in response to pressure wave 310. As illustrated, portions of pressure wave 312 are delayed by one quarter wavelength in the fluid ($\lambda/4$) from corresponding portions of pressure wave 310. For example, the positive peaks of wave 312 occur near times t6 and t0. The $\lambda/4$ relationship is established by selection of the length of the tube in conjunction with the speed of sound (pressure variations) in the fluid and with the drive frequency (the operating frequency of oscillator 30), and is made in order to take advantage of the effects of pressure wave reflections.

As so far described, operation of diaphragm 22 of FIG. 1 under the control of oscillator 30 results in propagation of pressure waves toward small end 16 of tube 10. If small end 16 of tube 10 is closed off or capped, the pressure wave is fully reflected. For example, the positive peak of the pressure wave may be viewed as reflecting from the closed end and returning to diaphragm 22. The reflected wave at diaphragm 22 under such a condition will be of the same magnitude as the original pressure wave, having propagated to the small end with an increase of the pressure peak, and propagating back toward the large end with a corresponding decrease in peak pressure. If the positive or compression peak so reflected were to arrive simultaneously with the next positive-pressure peak excursion of diaphragm 22, the diaphragm would have to "push harder" in response to its drive in order to achieve its displacement. Selection of the round-trip length of tube 10 (and any additional cylindrical portion 18) to be near one-quarter wavelength ($\lambda/4$) causes the reflected pressure peak to occur at a time, such as time t12, when the diaphragm displacement is zero, i.e. the rest position, with the result that the reflected pressure peak has no effect on the driving force. In this case, the reflected wave is 90° out of phase with the driving wave. If the round-trip delay or duration is $\lambda/2$, corresponding to a 180° phase shift, the reflected pressure peak arrives at the diaphragm at a time when the diaphragm is being driven to a peak excursion in a direction which produces a rarefaction peak or a pressure minimum, and the reflected wave "helps" the oscillator to drive the diaphragm. The help provided by the reflected wave with 180° phase shift reduces the impedance into which the diaphragm works. So long as the end of the tube is closed as described above, no net flow of fluid through the tube can occur.

In actual operation of the compressor of FIG. 1, described below, the end of the tube 10 is not capped, but allows fluid to flow under certain conditions. The flow of fluid from small end 16 of tube 10 allows some of the energy represented by the pressure wave arriving at the small end to pass therethrough, with the result that less energy is available for reflection. Thus, in normal operation, the magnitude of the reflected pressure wave is less than or smaller than the magnitude of the initial or forward-direction pressure wave.

In operation of the compressor or pump of FIG. 1, oscillator 30 operates at a frequency selected so that a round trip of a pressure wave from diaphragm 22 to small end 16 of tube 10, and back to diaphragm 22, occurs during one-half of an operating cycle. The pressure wave propagates toward small end 16 of tube 10. When the pressure on the tube side of a leaf valve 38 momentarily exceeds the pressure in tank 36, the valve opens, allowing fluid to flow from small end 16 into tank 36. Tank 36 is assumed to be an accumulator, so the pressure therein does not increase very much in response to a single transfer of fluid from tube 10. Consequently, in the time interval represented as T2 to T4 of FIG. 3b, representing the interval during which valve 38 of FIG. 1 is open, the pressure at small end 16 of tube 10 remains fixed at a value arbitrarily represented as 10 units, which is a higher pressure than the pressure in supply tank 32. Since the pressure remains fixed during T2–T4 (where the hyphen represents the word "through"), pressure wave 312 of FIG. 3b is represented as being "flat-topped" in a region 314. The opening of valve 38 of FIG. 1, and exposure of the tube end 16 to the pressure in accumulator tank 36, may be viewed as resulting in the passing of a counter-propagating wave from tank 36 into small end 16 of tube 10, to thereby result in generation of the abovementioned reflection wave. This view makes it clear that the peak portion of the reflected wave is also flat-topped. When the peak portion of the reflected wave reaches large end 14 and diaphragm 22, it "subtracts" or offsets a portion of the drive pressure wave, illustrated as portion 316 of wave 310 of FIG. 3a. During normal operation, that portion of each pressure-wave cycle during which valve 38 is open will depend upon the peak pressure at small end 16 of tube 10 relative to the pressure in accumulator tank 36. As pressure builds up in the tank, the valve will open for a shorter and shorter period, until the tank pressure equals the peak pressure of the wave, at which time, in principle, the valve will remain closed. During each interval in which valve 38 is open, some fluid will be transferred from the tube to the accumulator tank.

Operation of valve 38 of FIG. 1 results in a net transfer of fluid through tube 10 to accumulator tank 36. This in turn would cause the average pressure within tube 10 to decrease, were it not for the connection to supply tank 32. Such a drop in average pressure, were it to occur due to lack of a fluid supply, would eventually cause pumping action to cease. The presence of fluid supply tank 32 communicating with large end 14 of tube 10 allows a net flow of fluid to enter tube 10 in response to the drop in average pressure occasioned by the pumping action of the compressor. In principle, no valve is needed other than valve 38, because the pressure difference controls the replacement fluid flow. However, an additional valve 34 may be provided, which responds to pressure differentials, and which blocks the replacement fluid flow from tank 32 during a portion of each operating cycle. Valve 34 prevents propagation of at least portions of the drive pressure waves into source tank 32, which might otherwise cause unwanted reflections which could upset normal pump operation.

FIG. 4 is a simplified block diagram of a refrigeration unit 400 in accordance with the invention. Elements of FIG. 4 corresponding to those of FIG. 1 are designated by like reference numerals. In FIG. 4, a piston 412 is connected by a wrist pin 413 to a connecting rod 414, which in turn is connected to a rotating crankshaft 416. Piston 412 is the driver which produces pressure waves in tube 10. The pressure waves propagating in tube 10 increase in temperature during compression, and heat may be dissipated by fins 420 attached to the outer wall of the tube. Alternatively, a further accumulator and heat dissipator may be added to the apparatus. As illustrated in FIG. 4, valve 38 opens directly into an expansion chamber 422, into which the compressed cooled fluid squirts during each pressure peak, thereby cooling the fluid within the expansion chamber, in known fashion. The cooled fluid leaves the expansion tank, and flows through cooling coils 424, across which air is blown by a fan illustrated as 426. The air moving across the cooling coils allows heat to be transferred from the air to the coils and to the fluid within, thereby heating the fluid in conventional fashion. The warmed fluid returns to a supply tank 428, where it again becomes available to the compressor.

Since the fluid pressure driver (the voice-coil actuator in FIG. 1 or the piston in FIG. 4) operates at relatively low pressures, it is not subjected to high pressure shocks which may result in excess noise and which may reduce reliability. The only moving part subjected to high pressure is valve 38. The valve may be designed for long life, as for example by use of the same general designs and principles as those used for valves for artificial hearts, and replacement heart valves. They may be made wholly or partially from resilient or elastic materials to reduce operating noise. If the operating frequency is supersonic, the valve operation should be inaudible to humans, and any residual noise may have the beneficial effect of tending to drive away rodents.

While the pump has been described as a compressor, reversing the operating direction of valve 38, if used, and of valve 34, will result in generation of a "vacuum" pump. Thus, the word "pressure" may include the meaning of rarefaction.

Other embodiments of the invention will be apparent to those skilled in the art. For example, the cross-section of tube 10 has been described as circular, but it may be polygonal, square or it may even have an arbitrary cross-sectional shape, so long as the cross-sectional area decreases toward the smaller end. While sinusoidal motion of the piston or diaphragm has been described, square-wave drive or other drive motions may be used, with the advantage of increased flow of pressurized fluid per unit time, but with the disadvantage of increased rate of change of fluid pressure on any moving parts. While a single tapered tube 10 has been illustrated as being connected to accumulator tank 36, a plurality of such tubes may be connected thereto, with their large ends driven in common by a single driver and a plenum, or with individual drivers for each tube. If such a plurality of tubes are used, they may have separate fluid supplies or a common supply. Also, if several tubes are connected in this fashion to a single accumulator tank, their drives may be synchronized to provide simultaneous pulses of pressurized fluid at the accumulator, or the drives may synchronized with a mutual phase shift or phase offset of 360°/N, where N is the number of tubes coupled to one accumulator, to provide a more continuous flow of pressurized fluid. While mechanical crankshaft/piston and electrical voice-coil actuators or drivers have been described as providing the pressure waves in the fluid, other devices or transducers may be used, such as piezoelectric or magnetostrictive devices, or chemical reactions could be used. The fluid may be gaseous or liquid, or take both forms at various points within the system, or the fluid might be a mass containing solid particles, or a mix of solid particles with liquid, such as a slurry, so long as the particles act in a fluid-like manner.

What is claimed is:

1. A fluid compressor for pressurizing fluid for use by a utilization apparatus, said compressor comprising:

a source of fluid:

reciprocating means coupled to said source of fluid for generating pressure pulses in said fluid;

an elongated tube including first and second ends, said tube including a bore tapering from a first diameter at said first end to a second diameter, smaller than said first diameter, at said second end, said first end being coupled to said reciprocating means and to said source of fluid for receiving said pressure pulses in said fluid, whereby said fluid pulses propagate from said first end of said tube toward said second end of said tube, and which arrive at said second end of said tube with increased pressure, said second end of said tube being coupled to said utilization means; and drive means coupled to said reciprocating means for causing said reciprocating means to reciprocate with a predetermined cycle period; and wherein said elongated tube has a dimension in the direction of elongation which is selected so that a pulse propagates through said fluid from said first end of said tube to said second end of said tube in a time greater than one-tenth of said cycle period.

2. A compressor according to claim 1, wherein said dimension of said elongated tube in said direction of elongation is selected so that a pulse propagates through said fluid from said first end of said tube to said second end of said tube in a time approximately equal to an integer multiple of one-quarter of said cycle period.

3. A compressor according to claim 2, wherein said integer is two.

4. A compressor according to claim 1, wherein said elongated tube has a dimension in the direction of elongation which is selected so that a pulse propagates through said fluid from said first end of said tube to said second end of said tube in a time less than said cycle period.

* * * * *